US010920156B2

(12) United States Patent
Buchbinder et al.

(10) Patent No.: US 10,920,156 B2
(45) Date of Patent: Feb. 16, 2021

(54) PROCESS TO CONVERT ALIPHATICS AND ALKYLAROMATICS TO LIGHT OLEFINS WITH ACIDIC CATALYST

(71) Applicant: UOP LLC, Des Plaines, IL (US)

(72) Inventors: Avram M. Buchbinder, Skokie, IL (US); Stanley J. Frey, Palatine, IL (US); Karl Z. Steigleder, Glen Ellyn, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/783,843

(22) Filed: Oct. 13, 2017

(65) Prior Publication Data

US 2018/0179450 A1 Jun. 28, 2018

Related U.S. Application Data

(60) Provisional application No. 62/439,361, filed on Dec. 27, 2016.

(51) Int. Cl.
*C10G 47/04* (2006.01)
*C10G 11/05* (2006.01)

(52) U.S. Cl.
CPC ..... *C10G 47/04* (2013.01); *C10G 11/05* (2013.01); *C10G 2300/70* (2013.01); *C10G 2400/20* (2013.01); *C10G 2400/30* (2013.01)

(58) Field of Classification Search
CPC ..... C10G 11/05
See application file for complete search history.

(56) References Cited

U.S. PATENT DOCUMENTS 4,061,724 A 12/1977 Grose et al.
4,104,294 A 8/1978 Grose et al.
4,199,556 A * 4/1980 Plank ..... B01J 29/40 423/701
5,194,412 A * 3/1993 Roberie ..... B01J 29/06 502/64
6,124,227 A * 9/2000 Yao ..... B01J 29/061 502/63
7,271,123 B2 * 9/2007 Chang ..... B01J 29/85 502/208
7,314,963 B2 1/2008 Voskoboynikov et al.
7,317,133 B2 * 1/2008 Vora ..... C07C 1/20 585/324

(Continued)

FOREIGN PATENT DOCUMENTS

AU 742482 B2 1/2002
GB 2322364 A 8/1998

(Continued)

OTHER PUBLICATIONS

Thomas et. al., Gallozeolite Catalysts Preparation, Characterization, and Performance, . Phys. Chem. (ISSN 0022-3654) V90 N.20 4843-47 (Sep. 25, 1986), v 90, n 20, p. 4843-4847, Sep. 25, 1986.

(Continued)

*Primary Examiner* — Philip Y Louie
*Assistant Examiner* — Alyssa L Cepluch

(57) ABSTRACT

The process for producing light olefins comprises the steps of contacting a feed stream comprising $C_4$ to $C_{11}$ hydrocarbons having at least 10 wt % paraffins and at least 15 wt % alkylaromatics with an acidic catalyst to form a cracked product comprising light olefins and aromatics. The catalyst comprises about 30 to about 80 wt-% of a crystalline zeolite and a low-acidic binder and may be regenerated.

19 Claims, 3 Drawing Sheets

(56) References Cited

U.S. PATENT DOCUMENTS

| | | | | |
|---|---|---|---|---|
| 7,875,755 | B2 | 1/2011 | Voskoboynikov | |
| 2004/0102667 | A1 | 5/2004 | Vora et al. | |
| 2008/0051615 | A1* | 2/2008 | Stavens | B01J 29/126 585/266 |
| 2009/0143629 | A1 | 6/2009 | Voskoboynikov | |
| 2010/0331590 | A1* | 12/2010 | Majumder | C10G 11/00 585/315 |
| 2011/0230333 | A1* | 9/2011 | Voskoboynikov | B01J 29/035 502/68 |
| 2013/0296621 | A1* | 11/2013 | Iaccino | C07C 2/864 585/321 |

FOREIGN PATENT DOCUMENTS

| | | | |
|---|---|---|---|
| IN | 268279 | B | 8/2015 |
| RU | 2307863 | C2 | 10/2007 |

OTHER PUBLICATIONS

Pellet et. al., Skeletal rearrangement reactions of olefins, paraffins, and aromatics over aluminophosphate-based molecular sieve catalysts, 3rd Chem. Congr. North Am./195th ACS Natl. Meet. Div. Ind. Eng. Chem., Pet. Chem., Fuel Chem. Symp. (Toronto, Ont. 6/5-11/88) ACS Symp. Ser. N.368 512-31 (1988), 1988.

Idem et. al., Catalytic conversion of canola oil to fuels and chemicals: Roles of catalyst acidity, basicity, and shape selectivity on product distribution, Fuel Processing Technology (ISSN 0378-3820) V51 N.1-2 101-25 (Mar. 1997), v 51, n 1-2, p. 101-125, Mar. 1997.

Anderson et. al., Reactions of ZSM-5 Type Zeolite Catalysts, J. Catal. V58 N.1 114-30 (Jun. 15, 1979), v 58, n 1, p. 114-130, Jun. 15, 1979.

PCT Search Report dated Feb. 7, 2018 for corresponding PCT Application No. PCT/US2017/055870.

* cited by examiner

PROCESS TO CONVERT ALIPHATICS AND ALKYLAROMATICS TO LIGHT OLEFINS WITH ACIDIC CATALYST

CROSS-REFERENCE TO RELATED APPLICATION

This application claims priority from Provisional Application No. 62/439,361 filed Dec. 27, 2016, the contents of which cited application are hereby incorporated by reference in its entirety.

BACKGROUND

The present invention relates to converting a hydrocarbon feed to light olefins, especially to propylene and ethylene. In particular, the present invention relates to conversion of a hydrocarbon stream containing olefins, paraffins and alkylaromatics, through the use of a catalyst consisting of an acidic zeolite with a low-acidic binder, to butene, propylene, ethylene and aromatics.

A low cost supply of light olefins, particularly ethylene and propylene, continues to be in demand to serve as feed for polyolefins production, particularly polyethylene and polypropylene production. Propylene is an important chemical of commerce. In general, propylene is largely derived from selected petroleum feed materials by procedures such as steam cracking, which also produce high quantities of other materials. At times, there exist shortages of propylene, which result in uncertainties in feed supplies, rapidly escalating raw material costs and similar situations, which are undesirable from a commercial standpoint.

Propylene, a light olefin consisting of three carbon atoms wherein two of the carbon atoms are joined by a double bond, has a great number of commercial applications, particularly in the manufacture of polypropylene, isopropyl alcohol, propylene oxide, cumene, synthetic glycerol, acrylonitrile and oxo alcohols.

An object of the present invention is to provide a catalyst that cracks olefins, paraffins and dealkylates alkylaromatics to light olefins such as propylene and ethylene that is sufficiently robust to undergo regeneration including extensive transport for regeneration.

SUMMARY

A process for producing ethylene, propylene and aromatics in substantial yields comprises the steps of passing a feed stream comprising olefins and/or paraffins and/or alkylaromatics in the range of $C_4$ to $C_{11}$ into a reaction zone and contacting said feed stream with a catalyst to crack olefins and/or paraffins and/or dealkylate alkylaromatics to form a cracked product comprising olefins and aromatics. The catalyst comprises about 30 to 80 wt % acidic zeolite with a maximum pore diameter of greater than 5 Angstroms and about 20 to 70 wt % low-acidic binder selected from the group consisting of $AlPO_4$, $SiO_2$ and $ZrO_2$.

The cracking and dealkylation is preferably carried out in a moving-bed reaction zone wherein feed and catalyst are contacted at effective olefin generation conditions. During the reaction, a carbonaceous material called coke is deposited on the catalyst. The carbonaceous deposit material has the effect of reducing the number of active sites on the catalyst, which thereby affects the yield. In an embodiment, coked catalyst may be withdrawn from the reaction zone and regenerated to remove at least a portion of the carbonaceous material and returned to the reaction zone. Depending upon the particular catalyst, it can be desirable to substantially remove the carbonaceous material, e.g., to less than 0.1 wt-%, or only partially regenerate the catalyst, e.g., to from about 1 to 5 wt-% carbon. Preferably, the regenerated catalyst will contain about 0 to 1 wt-% and more preferably from about 0 to 0.5 wt-% carbon. Alternatively, the catalyst can be regenerated in situ by taking one of multiple reactors off-line for regeneration in cyclical fashion or in semi-regenerative mode where all reactors are taken offline for regeneration at one time.

Additional objects, embodiments and details of this invention can be obtained from the following detailed description of the invention.

DETAILED DESCRIPTION

Figure 1:
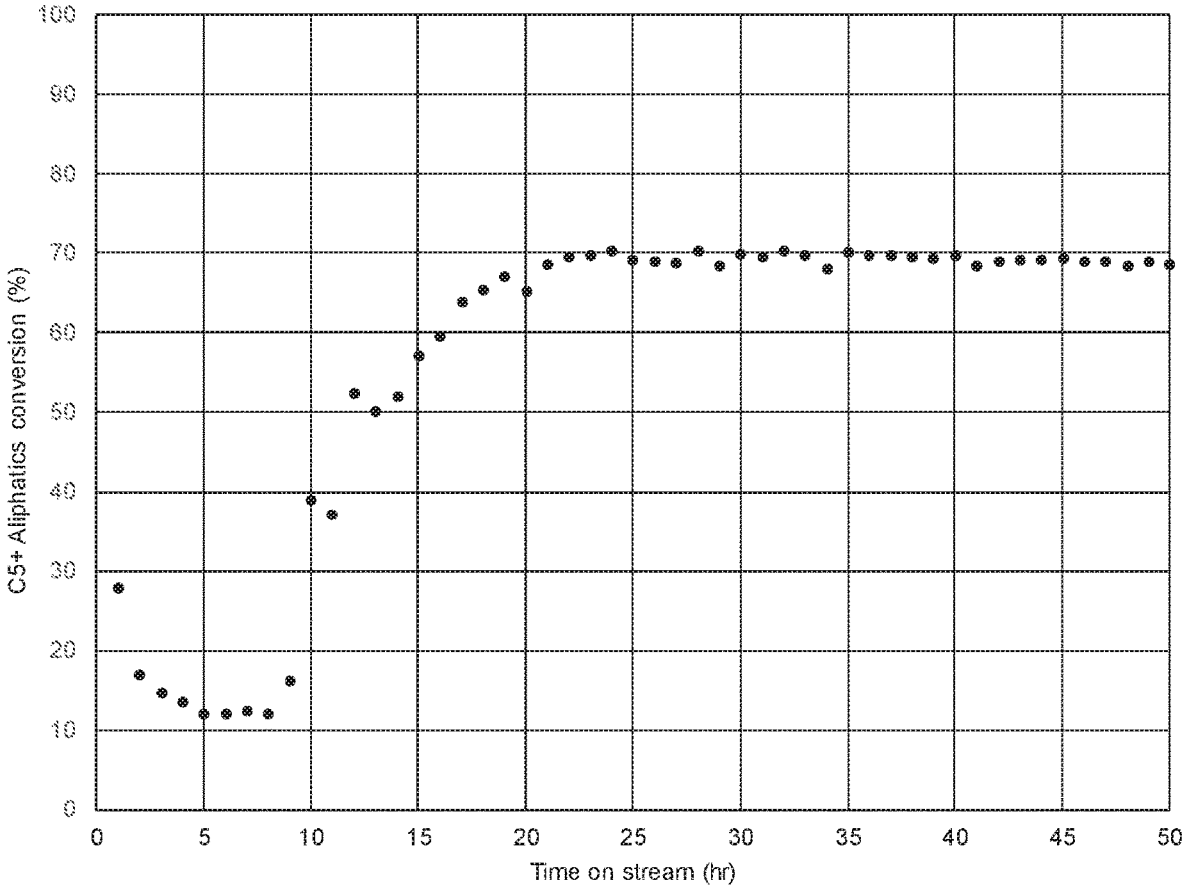
FIG. 1 is a plot of $C_{5+}$ aliphatics conversion versus time on stream for aluminum phosphate bound catalyst.

The present process for producing light olefins comprises contacting a feed stream comprising $C_4$ to $C_{11}$ hydrocarbons having at least about 10 wt % paraffins and at least about 15 wt % alkylaromatics with an acidic catalyst to form a cracked product. The catalyst comprises about 30 to about 80 wt % of an acidic zeolite. The reaction conditions include a temperature from about 500° to about 650° C., an WHSV in the range of about 0.75 to about 6.0 $hr^{-1}$, suitably no more than about 4 $hr^{-1}$, preferably no more than about 3.75 $hr^{-1}$ and most preferably no more than about 3.0 $hr^{-1}$. The term "WHSV" is defined herein as the mass flow rate of liquid feed divided by the mass of the catalyst bed. The liquid hourly space velocity (LHSV) in the cracking reactor may be between about 0.1 to about 4.0 $hr^{-1}$ and preferably about 0.5 to about 2 or about 2.5 $hr^{-1}$. The term "LHSV" is defined herein as the volumetric flow rate of liquid feed divided by the volume of the catalyst bed. The relationship between LHSV and WHSV depends on the feed density and the catalyst apparent bulk density.

In an embodiment, any naphtha stream boiling in the naphtha boiling range may be taken as a feed stream in the present process. A naphtha feed stream may have a T5 boiling point in a range of about 0° C. to about 82° C. and a T95 boiling point in a range of about 82° C. to about 215° C. As used herein, the term "T5" or "T95" means the temperature at which 5 volume percent or 95 volume percent, as the case may be, respectively, of the sample boils using ASTM D-86.

The feed stream may have an aromatic content of at least 30 wt %, with at least 50 wt % preferred. Moreover, the cracking feed stream may have a concentration of aromatic alkyl groups in the $C_1$-$C_4$ range of about 10 to about 30 wt % and preferably about 15 to about 25 wt %. At least 10 wt %, preferably at least 15 wt % of the aromatic alkyl groups in the feed stream may comprise $C_2$-$C_4$ alkyl groups. The feed stream may have about 5 to about 40 wt % and typically about 10 to about 25 wt % alkyl aromatics with $C_2$ to $C_4$ alkyl groups. The cracking feed stream may have about 5 to about 40 wt %, preferably 10 to 30 wt % aliphatics in the $C_5$ to $C_9$ range. The cracking feed stream need not comprise olefins.

The temperature in the cracking reactor may be in the range of about 500 to about 700° C., or about 525 to about 650° C. and preferably about 550 to about 590° C. The pressure can be in the range of in a range of about 0 kPa (gauge) (0 psig) to about 750 kPa (g) (109 psig), or about 100 kPa (g) (15 psig) to about 400 kPa (g) (58 psig).

Hydrogen diluent may be added for catalyst stability. The molar ratio of hydrogen to $C_{5+}$ hydrocarbon ratio at an inlet to the cracking reactor may at least about 0.5:1, or at least, preferably at least about 2:1 and no more than about 6:1, and most preferably no more than about 5:1. The hydrogen may be provided from a reformer effluent. Hydrocarbon partial pressures may range from about 62 to about 345 kPa (9 to 50 psia), preferably from about 140 to about 245 kPa (20 to 35 psia).

These conditions will be such that at least about 50 to about 80 wt-% of aliphatics will be converted and at least about 50 to about 80 wt-% of the $C_2$-$C_4$ alkyl aromatics will be dealkylated to the corresponding light olefin and aromatics. Aromatic $C_1$-$C_4$ alkyl groups are dealkylated to olefins and aromatics at over 10% by weight, but aromatic $C_2$-$C_4$ alkyl groups are dealkylated at over 50% by weight, and typically at over 60% by weight. Aromatic $C_1$ alkyl groups are converted at less than about 10% by weight, typically at less than about 6% by weight and preferably less than about 3% by weight. Aromatic $C_1$ alkyl group conversion is undesired. The term "$C_x$" or "$A_x$" are to be understood to refer to aliphatic and aromatic molecules, respectively, having the number of carbon atoms represented by the subscript "x". Similarly, the term "$C_{x-}$" or "$A_{x-}$" refers to aliphatic and aromatic molecules, respectively, that contain less than or equal to x and preferably x and less carbon atoms. The term "$C_{x+}$" or "$A_{x+}$" refers to aliphatic and aromatic molecules, respectively, with more than or equal to x and preferably x and more carbon atoms. A $C_x$ alkyl aromatic refers to an alkyl aromatic that contains an alkyl chain containing x carbon atoms, but may contain other alkyl chains as well. $C_2$-$C_4$ alkyl aromatics are defined such that an alkyl aromatic that contains an alkyl chain with x carbon atoms and an additional or additional chain or chains with other numbers of carbon atoms. For example, 2-ethyltoluene is a $C_2$-$C_4$ alkyl aromatic. Typically, substantial yields of ethylene, propylene and butylene are produced in the cracking reactor. Substantial yields means at least 5 wt %, suitably at least 10 wt % and preferably at least 20 wt % of ethylene, propylene and butylene combined. "Yield" in this case is defined as the weight of the product in the cracked effluent stream, divided by the combined weight of non-aromatics and the alkyl-aromatic side chains in the feed. Accordingly, the aromatic rings are not counted as feed in this yield calculation. $C_{5+}$ aliphatics and alkylaromatics in the stream are converted to $C_{4-}$ products, and that resulting propylene comprises at least about 50 mol-%, preferably at least about 70 mol-% of the total $C_3$ reaction products with the weight ratio of propylene/total $C_{2-}$ products of at least about 0.3 and preferably at least about 0.6. Most preferably the ethylene comprises at least 60 mol-% of the $C_2$ products.

The process cracks paraffins and dealkylates alkylaromatics to achieve high olefin yields from an aliphatic and alkyl aromatic portion of a reformate stream. If present in the feed, process cracks olefins and naphthenes to olefins. Hence, a valuable petrochemical product is generated from a portion of a reformate or a naphtha stream which would otherwise be considered of fuel grade rather than of petrochemical grade. Alkylaromatics such as ethylbenzene and propylbenzene are dealkylated to produce olefins and aromatics which reduces the size of downstream aromatics units or allows more aromatic feed throughput.

The catalyst used in the present invention consists of about 30 to about 80%, suitably 40 to about 70%, by weight of a high silica MFI-type zeolite, also known as silicalite, with a molar $Si/Al_2$ ratio of about 200 to about 1200, suitably about 300 to about 1100, typically no more than about 700, and preferably between about 300 and about 500. The catalyst may comprise about 20 to about 70% by weight, suitably about 30 to about 60% by weight of a low-acidic binder comprising amorphous aluminum phosphate, formed by sol-gel methods. Low acidic binder has no more than 0.2, preferably no more than 0.15 millimoles of acid sites per gram as determined by gas-phase ammonia titration. The amorphous aluminum phosphate typically contains some or all of amounts of phosphate, hydrogen phosphate, dihydrogen phosphate, hydrogen phosphite, dihydrogen phosphite, aluminum oxide, aluminum hydroxide and aluminum oxyhydroxide. As such, the atomic ratio of Al/P is not necessarily 1. The aluminum phosphate has an atomic ratio of Al/P of about 0.5:1 to about 2:1, suitably about 0.85 to about 1.5 and preferably about 0.95 to about 1.4. Silicalite is a hydrophobic crystalline silica molecular sieve. Silicalite is disclosed in U.S. Pat. No. 4,061,724 B 1 and U.S. Pat. No. 4,104,294 B 1. Silicalite differs from other zeolites in that silicalite does not exhibit appreciable ion exchange properties as $AlO_4$ tetrahedra do not comprise a portion of the crystalline silica framework.

The binder serves the purpose of maintaining the shape and strength of the catalyst particles. The binder may be incorporated with the zeolite in any acceptable manner known to those skilled in the art. Examples of such incorporation techniques include sol-gel oil-dropping, pillings, nodulizing, marumerization, spray drying, extrusion, pelletizing, or any combination of these techniques.

The preferred shape of the catalyst is spherical particles, which are preferably formed by the sol-gel oil dropping methods as described below. Spherical particles have good resistance to attrition and are well suited to a moving-bed type reactor with continuous regeneration of catalyst withdrawn from the reactor. In hydrocarbon reactions, the catalysts gradually deactivate due to coke formation on the catalyst. A spherical shaped catalyst can be readily moved from the reactor through a regeneration section and back to the moving bed, allowing for both continuous reaction and continuous regeneration of the catalyst. The formed catalyst may have median diameter of about 0.5 to about 3 mm and preferably about 1.3 to about 2.1 mm.

The catalyst does not include a hydrogenating metal function. For example, the catalyst may have 0 to about 0.1 wt-% transition metals in IUPAC Groups 5 to 12 on the Periodic Table on the catalyst, with zero being preferred. The absence of such hydrogenating transition metals assures that olefins will not be hydrogenated in the cracking reactor to preserve olefins, particularly when substantial hydrogen is present.

The presence of alkali metal, including lithium, sodium, potassium, rubidium and cesium, decreases activity of the catalyst in the process and selectivity of the cracking reactions to produce olefins rather than paraffins and coke. Starting materials can be used which are substantially free of alkali metals or they can be removed from the zeolite or the catalyst by methods known to one skilled in the art. The catalyst should include less than about 200 wppm, suitably less than about 100 wppm and preferably less than about 70 wppm alkali metal.

The silicalite zeolite used in the catalyst may be calcined, acid-washed, ion-exchanged and/or steamed prior to being combined with the binder and formed into the spherical catalyst shape. Alternatively, the silicalite zeolite may be combined with the binder and formed into the spherical catalyst shape before calcining and steaming, ion exchanging or acid washing. More than one step of calcining, acid washing, ion exchanging or steaming may be used. Such modifications may be made as known to one skilled in the art.

A low-acidic binder is used, such as $AlPO_4$, $SiO_2$ or $ZrO_2$. The preferred binder is $AlPO_4$ with a preferably stoichiometric ratio of aluminum to phosphorous. This formulation results in a binder with essentially no acidity and thereby avoids potential undesirable reactions that could lower selectivity, stability and product purity. In the preferred embodiments of the present invention, it is formed from water-soluble aluminum and phosphorous compounds. The phosphorus may be incorporated with the alumina in any acceptable manner known to those skilled in the art. Examples of such incorporation techniques include pillings, nodulizing, marumerization, spray drying, extrusion, or any combination of these techniques. One preferred method of preparing this phosphorus-containing alumina is the gelation of a hydrosol precursor in accordance with the well-known oil drop method. A phosphorus compound is added to an alumina hydrosol to form a phosphorus-containing alumina hydrosol. Representative phosphorus-containing compounds which may be utilized in the present invention include: $H_3PO_4$, $H_3PO_2$, $H_3PO_3$, $(NH_4)H_2PO_4$, $(NH_4)_2HPO_4$, $K_3PO_4$, $K_2HPO_4$, $KH_2PO_4$, $Na_3PO_4$, $Na_2HPO_4$, $NaH_2PO_4$, $PX_3$, $RPX_2$, $R_2PX$_, $R_3P$, $X_3PO$, $(XO)_3PO$, $(XO)_3P$, $P_3PO$, $R_3PS$, $RPO_2$, $RPS_2$, $RP(O)(OX)_2$, $RP(S)(SX)_2$, $R_2P(O)OX$, $R_2P(S)SX$, $RP(OX)_2$, $RP(SX)_2$, $ROP(OX)_2$, $RSP(SX)_2$, $(RS)_2PSP(SR)_2$ and $(RO)_2POP(OR)_2$, where R is an alkyl or aryl, such as a phenyl radical, and X is hydrogen or a halide. These compounds include primary, $RPH_2$, secondary, $R_2PH$ and tertiary, $R_3P$ phosphines such as butyl phosphine, and tertiary phosphine oxides $R_3PO$, such as tributylphosphine oxide, the tertiary phosphine sulfides, $R_3PS$, the primary, $RP(O)(OX)_2$, and secondary, $R_2P(O)OX$, phosphonic acids such as benzene phosphonic acid, the corresponding sulfur derivatives such as $RP(S)(SX)_2$ and $R_2P(S)SX$, the esters of the phosphonic acids such as dialkyl phosphonate, $(RO)_2P(O)H$, dialkyl alkyl phosphonates, $(RO)_2P(O)R$, and alkyl dialkyl-phosphinates, $(RO)P(O)R_2$; phosphinous acids, $R_2PDX$, such as diethylphosphinous acid, primary, $(RO)P(OX)_2$, secondary, $(RO)_2POX$, and tertiary, $(RO)_3P$, phosphites, and esters thereof, such as the monopropyl ester, alkyl dialkylphosphinites, $(RO)PR_2$ and dialkyl alkylphosphinite, $(RO)_2PR$, esters. Corresponding sulfur derivatives may also be employed including $(RS)_2P(S)H$, $(RS)_2P(S)R$, $(RS)P(S)R_2$, $R_2PSX$, $(RS)P(SX)_2$, $(RS)_2PSX$, $(RS)_3P$, $(RS)PR_2$ and $(RS)_2PR$. Examples of phosphite esters include trimethylphosphite, triethylphosphite, diisopropylphosphite, butylphosphite, and pyrophosphites such as tetraethylpyrophosphite. The alkyl groups in the mentioned compounds preferably contain one to four carbon atoms.

Other suitable phosphorus-containing compounds include ammonium hydrogen phosphate, the phosphorus halides such as phosphorus trichloride, bromide, and iodide, alkylphosphorodichloridites, $(RO)PCl_2$, dialkylphosphorochloridites, $(RO)_2PCl$, dialkylphosphinochloridites, $R_2PCl$, alkyl alkylphosphonochloridates, $(RO)(R)P(O)Cl$, dialkylphosphinochloridates, $R_2P(O)Cl$ and $RP(O)Cl_2$. Applicable corresponding sulfur derivatives include $(RS)PCl_2$, $(RS)_2PCl$, $(RS)(R)P(S)Cl$ and $R_2(S)Cl$.

The alumina hydrosol is typically prepared by digesting aluminum in aqueous hydrochloric acid and/or aluminum chloride solution at about reflux temperature, usually from about 80° to about 105° C., and reducing the chloride compound concentration of the resulting aluminum chloride solution by the device of maintaining an excess of the aluminum reactant in the reaction mixture as a neutralizing agent. The alumina hydrosol is an aluminum chloride hydrosol, variously referred to as an aluminum oxychloride hydroxol, aluminum hydroxychloride hydrosol, and the like, such as is formed when utilizing aluminum metal as a neutralizing agent in conjunction with an aqueous aluminum chloride solution. In any case, the aluminum chloride is prepared to contain aluminum in from about a 0.7:1 to about 1.5:1 weight ratio with the chloride compound content thereof.

In one specific embodiment, the phosphorus compound is mixed with a gelling agent before admixing with the alumina hydrosol. It is preferred that said alumina hydrosol contain the active catalytic component of the first or second discrete catalyst. Commingling of the alumina hydrosol, containing said active catalytic component, with the phosphorus-gelling agent mixture is effected by any suitable means. The resultant admixture is dispersed as droplets in a suspending medium, e.g. oil, under conditions effective to transform said droplets into hydrogel particles.

The gelling agent is typically a weak base which, when mixed with the hydrosol, will cause the mixture to set to a gel within a reasonable time. In this type of operation, the hydrosol is typically coagulated by utilizing ammonia as a neutralizing or setting agent. Usually, the ammonia is furnished by an ammonia precursor, which is added to the hydrosol. The precursor is suitably hexamethylenetetramine (HMT), or urea, or mixtures thereof, although other weakly basic materials, which are substantially stable at normal temperatures, but decompose to form ammonia with increasing temperature, may be suitably employed. It has been found that equal volumes of the hydrosol and of the HMT solution to alumina sol solution are satisfactory, but it is understood that this may vary somewhat. The use of a smaller amount of HMT solution tends to result in soft spheres while, on the other hand, the use of larger volumes of base solution results in spheres, which tend to crack easily. Only a fraction of the ammonia precursor is hydrolyzed or decomposed in the relatively short period during which initial gelation occurs.

An aging process is preferably subsequently employed. During the aging process, the residual ammonia precursor retained in the spheroidal particles continues to hydrolyze and effect further polymerization of the hydrogel whereby desirable pore characteristics are established. Aging of the hydrogel is suitably accomplished over a period of from about 1 to about 24 hours, preferably in the oil suspending medium, at a temperature of from about 60° to about 150° C. or more and at a pressure to maintain the water content of the hydrogel spheres in a substantially liquid phase. The aging of the hydrogel can also be carried out in an aqueous $NH_3$ solution at about 95° C. for a period up to about 6 hours. Following the aging step, the hydrogel spheres may be washed with water containing ammonia.

The phosphorus-containing alumina component of the discrete catalysts of the present invention may also contain minor proportions of other well-known inorganic oxides such as silica, titanium dioxide, zirconium dioxide, tin oxide, germanium oxide, chromium oxide, beryllium oxide, vanadium oxide, cesium oxide, hafnium oxide, zinc oxide, iron oxide, cobalt oxide, magnesia, boria, thoria and the like materials which can be added to the hydrosol prior to dropping.

A preferred method for producing the catalyst involves the following procedure: Silicalite powder, aluminum hydroxychloride solution containing 12 to 15 wt % A) and 85 wt-% phosphoric acid are weighed out in appropriate amounts to make a formulation containing on a volatile-free basis 60 wt % silicalite and 40 wt % aluminum phosphate to achieve close to a 1:1 Al/P atomic weight ratio. The silicalite is dispersed in water by appropriate means with stirring, milling or other means to form a concentrated slurry of about 50 wt % silicalite. The aluminum sol is processed, cooled, diluted with water and mixed with $H_3PO_4$ to form an $AlPO_4$ solution with 2 to 7 wt % aluminum. The silicalite slurry and $AlPO_4$ solution are then mixed, along with a solution of a gelling agent, HMT, which releases four moles of $NH_3$ on heating. The amount of ammonia from HMT added corresponds to about 100 to 250 mol-% of the chlorine content of the aluminum hydroxychloride that is used. The mixture is then fed through a vibrating perforated disc or tube to form droplets, which are directed into a heated paraffin oil column, resulting in formation of rigid spherical particles of silicalite-$AlPO_4$ gel. The gelled particles are collected at the bottom of the column, aged for several hours in hot paraffin oil and then washed with a heated dilute aqueous $NH_3$ solution. The washed spheres are then dried and calcined, to form the final spherical catalyst particles. The order of mixing of most of the components can be changed. For example, an equivalent catalyst can be formed by first mixing the silicate slurry with the aluminum sol, mixing the $H_3PO_4$ with the HMT solution and water and then combining these to form the dropping mixture. Alternatively, the silicalite slurry, $H_3PO_4$, HMT solution and water may be combined simultaneously to form the dropping mixture. The resulting product is silicalite bound with amorphous $AlPO_4$.

Similar procedures can be utilized to make catalysts with silica and zirconia binder.

The catalysts may be contained in a fixed-bed system or a moving-bed system with associated continuous catalyst regeneration, whereby catalyst may be continuously withdrawn, regenerated and returned to the reactors. These alternatives are associated with catalyst-regeneration options known to those of ordinary skill in the art, such as: (1) a semi-regenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and return to the reactors of the reactivated catalyst as described herein; or (4) a hybrid system with semi-regenerative and continuous-regeneration provisions in the same zone. The preferred embodiment of the present invention is a moving-bed reactor with a continuous catalyst regeneration section. During the regeneration process, a portion of the coked catalyst is withdrawn from the reaction zone and regenerated to remove contaminants including the carbonaceous material. Depending upon the particular catalyst and conversion, it can be desirable to substantially remove the carbonaceous material, e.g. to less than 1 wt-%. Moreover, regeneration conditions can be varied depending upon catalyst used and the type of contaminant material present upon the catalyst prior to its regeneration. The conditions for regeneration may include an oxygen concentration of about 0.1 to about 21 mol % oxygen at 360 to about 650° C.

EXAMPLES

Example 1

A catalyst was prepared with aluminum phosphate binder and silicalite zeolite with zeolite to binder weight ratio of 60/40. A zeolite-water suspension was prepared by addition of 9,978 g silicalite (volatile-free) to 9,956 g water with stirring. The silicalite had been calcined, steamed and acid-washed and had a molar ratio of silica to alumina of about 420. The resulting mixture was then circulated through a bead mill for 5-30 minutes. Three additional mixtures in water were prepared containing a 44.5 wt % solution of HMT, 85 wt % $H_3PO_4$ acid, and an aluminum chlorohydrate solution comprising 11.08 wt % Al, 12.64 wt % Cl, respectively. In the process for preparing the mixtures, the solutions were cooled to about 3 to about 15° C. The mixtures were pumped through a vibrating tube or cylinder with perforations at the outlet end to form droplets which are directed into a vertical column containing paraffin oil heated to about 90 to about 100° C. The flow rates of the mixtures were 98.2, 60.9, 34.8 and 30.8 g/min for the zeolite mixture, aluminum chlorohydrate solution, the HMT solution and the $H_3PO_4$ solution, respectively. As the droplets fall though the oil column, spherical gel particles form and were collected at the outlet. The gel spheres were held in oil at 90 to 145° C. for 1-20 hours. The spheres were then drained of oil, transferred into a vertical washing column and washed for about 1 to 4 hours at about 69 to 88° C. in a continuous flow of water containing about 0.005 to 0.5 wt-% $NH_3$. The washed spheres were drained, dried at about 79 to 121° C. and oven-calcined in air at about 345 to about 625° C. for about 1 to 3 hours. The preparation yields a final spherical catalyst.

The finished catalyst was analyzed by inductively charged plasma-atomic emission spectroscopy and found to contain 8.54 wt % aluminum, 28.7 wt % silicon, 9.74 wt % phosphorous, having a mole ratio of aluminum to phosphorous of 1.01, and 6-10 wppm sodium. The only IUPAC Group 5-12 metal detected was 330 wppm of iron. The sample was analyzed by X-ray diffraction. The diffraction pattern was consistent with monoclinic MFI zeolite with no other crystalline phases observed, indicating that the binder was amorphous. The intensity of the diffraction peaks relative to a zeolite reference indicated that the catalyst was composed of 51-52% crystalline zeolite.

Example 2

Sixty cubic centimeters (32.8 g) of a catalyst prepared in Example 1 was loaded in a fixed bed reactor in a furnace in three separate catalyst plugs of 15, 15 and 30 cubic centimeters separated by quartz wool and alpha alumina filler. The reactor was configured such that the reformate feed with the composition shown in Table 1 was vaporized and mixed with hydrogen in a reactor pre-heat zone. Liquid and vapor products were separated at the reactor outlet which was maintained at 172 kPa (gauge) (25 psig). The reactor was heated to 424° C., measured at 2 inches above catalyst bed inlet, under hydrogen, and liquid feed flow was initiated at a flow rate to achieve a WHSV of 3 $hr^{-1}$ (LHSV of 2 $hr^{-1}$) and a mole ratio of hydrogen to hydrocarbons of 4.5:1. Then temperature was increased to 496° C. for 10 hours. Finally, temperature was increased to 579° C., liquid feed rate was decreased to achieve a WHSV of 0.9 hr-1 (LHSV of 0.6 $hr^{-1}$) and hydrogen flow rate was decreased to achieve mole ratio of hydrogen to hydrocarbons of 3:1 thus comprising a hydrogen concentration of 75 mol %. Flows continued for an additional 40 hours. The gas and liquid products were analyzed separately by gas chromatography. Effluent composition is shown in Table 1.

TABLE 1

| Reformate Feed | | |
|---|---|---|
| Component | Feed, wt % | Product, wt % |
| $C_1$ Paraffin | 0.000 | 1.362 |
| $C_2$ Paraffins | 0.000 | 2.198 |
| $C_3$ Paraffins | 0.001 | 2.341 |
| $C_4$ Paraffins | 0.002 | 1.041 |
| $C_5$ Paraffins | 1.829 | 0.998 |
| $C_6$ Paraffins | 11.377 | 3.267 |
| $C_7$ Paraffins | 9.992 | 1.961 |
| $C_8$ Paraffins | 2.742 | 0.485 |
| $C_5$ Naphthenes | 0.022 | 0.000 |
| $C_6$ Naphthenes | 0.316 | 0.065 |
| $C_7$ Naphthenes | 0.431 | 0.295 |
| $C_8$ Naphthenes | 0.305 | 0.107 |
| $C_{5+}$ Aliphatics | 28.1 | 8.6 |
| $C_{9+}$ Paraffins, Naphthenes and Olefins | 0.309 | 0.749 |
| Ethylene | — | 4.189 |
| Propylene | 0.001 | 6.303 |
| $C_4$ Olefins | 0.002 | 2.691 |
| $C_5$ Olefins | 0.056 | 0.486 |
| $C_6$ Olefins | 0.335 | 0.144 |
| $C_7$ Olefins | 0.205 | 0.006 |
| $C_8$ Olefins | 0.141 | 0.044 |
| Benzene | 6.643 | 9.802 |
| Toluene | 18.806 | 23.812 |
| Xylene | 20.940 | 20.870 |
| Ethylbenzene | 3.117 | 0.712 |
| Trimethylbenzene | 8.941 | 8.703 |
| Methyl-Ethyl-Benzene | 6.191 | 1.829 |
| Propyl-Benzene | 1.577 | 0.219 |
| Tetra-Methyl Benzene | 1.810 | 1.491 |
| Di-Methyl-Ethyl Benzene | 0.212 | 9.802 |
| Methyl-Propyl-Benzene | 1.198 | 23.812 |
| Di-Ethyl-Benzene | 0.841 | 20.870 |
| Butyl-Benzene | 0.149 | 0.712 |
| $C_{11+}$ Aromatics | 1.508 | 8.703 |
| Aromatic Alkyls[a] | 18.7 | 16.2 |
| Aromatic $C_2$-$C_4$ Alkyls[a] | 3.6 | 1.1 |

[a]Aromatic alkyls counted the weight of aromatic alkyl substituents assuming molecular weights of 56.11 g/mol for butyl, 42.08 g/mol for propyl, 28.05 g/mol for ethyl and 16.04 g/mol for methyl substituents.

Yields and conversions are shown in Table 2. Yields were calculated by dividing the difference of a particular product component in the product less the particular product in the feed in wt % by the amount of $C_{5+}$ aliphatics and aromatic side chains in the feed in wt %. The $C_{4-}$ olefin/paraffin ratio was determined by determine selectivities for each $C_{4-}$ olefin and paraffin, by dividing yield in wt % for that component by $C_{5+}$ aliphatic and aromatic alkyls conversion, adding the selectivities for $C_{4-}$ olefins and for $C_{4-}$ paraffins and taking their ratio of the sums.

Conversion was determined by the difference in component in the product and the feed in weight percent and dividing the difference by the component in the feed in weight percent. Specifically, conversion of aliphatics was determined by summing aliphatics in the feed and summing the of aliphatics in the gas and liquid products in weight percent and dividing the difference by aliphatics in the feed in weight percent and is shown in FIG. 1. Aromatic alkyl group conversion was calculated in mol/100 g and then converted to weight percent for determining $C_1$-$C_4$ aromatic conversion. Alkyls $C_{5+}$ aliphatic and aromatic alkyls conversion was determined by the difference in $C_{5+}$ aliphatic and $C_1$-$C_4$ aromatic alkyls in the product and the feed in weight percent and dividing the difference by the $C_{5+}$ aliphatic and aromatic alkyls in the feed in weight percent.

Aromatic ring balance was the ratio of the difference of the $C_6$-$C_{10}$ aromatics in the effluent and the $C_6$-$C_{10}$ aromatics in the feed in mol/100 g to the aromatics in the feed in mol/100 g. In these calculations, hydrogen gas was not considered in the component weight and mol percentages.

TABLE 2

| Yields (wt %) | |
|---|---|
| Methane | 2.9 |
| Ethane | 4.7 |
| Ethylene | 9.0 |
| Propane | 5.0 |
| Propylene | 13.5 |
| Butanes | 2.2 |
| Butylenes | 5.7 |
| $C_6$-$C_{10}$ rings | 2.0 |
| $C_{11+}$ | 1.9 |
| $C_1$-$C_4$ olefin | 28.2 |
| $C_1$-$C_4$ paraffin | 14.8 |
| **Ratios and Ring Balance** | |
| $C_{4-}$ olefin/paraffin ratio | 1.9 |
| $C_6$-$C_{10}$ aromatic ring balance | 101.8 |
| **Conversion** | |
| $C_{5+}$ Aliphatics | 69.3 |
| Aromatic Methyl | 0 |
| Aromatic Ethyl | 65.3 |
| Aromatic Propyl | 83.6 |
| Aromatic Butyl | 91.9 |
| $C_1$-$C_4$ Aromatic Alkyls[a] | 13 |
| $C_2$-$C_4$ Aromatic Alkyls[a] | 70 |
| $C_{5+}$ Aliphatic and $C_1$-$C_4$ Aromatic Alkyls | 47.0 |

Results indicate C5+ aliphatics are cracking and C4− alkyl aromatics are dealkylating at significant conversion levels to substantial yields of light olefins ethylene, propylene and butylene. Conversion to light olefins is more significant than conversion to light paraffins. Additionally, the $C_6$-$C_{10}$ aromatic ring balance of over 100% indicates that aromatics are being generated in addition to aromatics resulting from dealkylation.

Examples 3-5

An extruded catalyst was prepared from 70 wt % silicalite zeolite with a ratio of silica to alumina of 460 and 30 wt % silica binder. The extruded catalyst was dealuminated, calcined and depleted of alkali metal. The finished catalyst had a BET surface area of 313 $m^2/g$ and micropore volume of 0.14 cc/g as determined by nitrogen adsorption. The finished catalyst including binder had 30 wppm sodium, 0.17 wt % aluminum, 46.8 wt % silicon analyzed by inductively coupled plasma-atomic emission spectroscopy. Sixty cubic centimeters (40.0 g) of the catalyst was loaded in a fixed bed reactor in three separate catalyst plugs of 15, 15 and 30 cubic centimeters separated by quartz wool and alpha alumina filler. A reformate feed with the composition shown in Table 3 was vaporized and mixed with hydrogen. Liquid and vapor products were separated at the reactor outlet which was maintained at 276 kPa (40 psia). The gas and liquid products were analyzed separately by gas chromatography.

TABLE 3

| Reformate Feed | |
|---|---|
| Component | Wt % |
| $C_1$ Paraffin | — |
| $C_2$ Paraffins | — |
| $C_3$ Paraffins | 0.001 |
| $C_4$ Paraffins | 0.002 |
| $C_5$ Paraffins | 1.829 |
| $C_6$ Paraffins | 11.377 |
| $C_7$ Paraffins | 9.992 |
| $C_8$ Paraffins | 2.742 |
| $C_5$ Naphthenes | 0.022 |
| $C_6$ Naphthenes | 0.316 |
| $C_7$ Naphthenes | 0.431 |
| $C_8$ Naphthenes | 0.305 |
| $C_{9+}$ Paraffins, Naphthenes and Olefins | 0.309 |
| Ethylene | — |
| Propylene | 0.001 |
| $C_4$ Olefins | 0.002 |
| $C_5$ Olefins | 0.056 |
| $C_6$ Olefins | 0.335 |
| $C_7$ Olefins | 0.205 |
| $C_8$ Olefins | 0.141 |
| Benzene | 6.643 |
| Toluene | 18.806 |
| Xylene | 20.940 |
| Ethylbenzene | 3.117 |
| Trimethylbenzene | 8.941 |
| Methyl-Ethyl-Benzene | 6.191 |
| Propyl-Benzene | 1.577 |
| Tetra-Methyl Benzene | 1.810 |
| Di-Methyl-Ethyl Benzene | 0.212 |
| Methyl-Propyl-Benzene | 1.198 |
| Di-Ethyl-Benzene | 0.841 |
| Butyl-Benzene | 0.149 |
| $C_{11+}$ Aromatics | 1.508 |

Example 3

Figure 2:
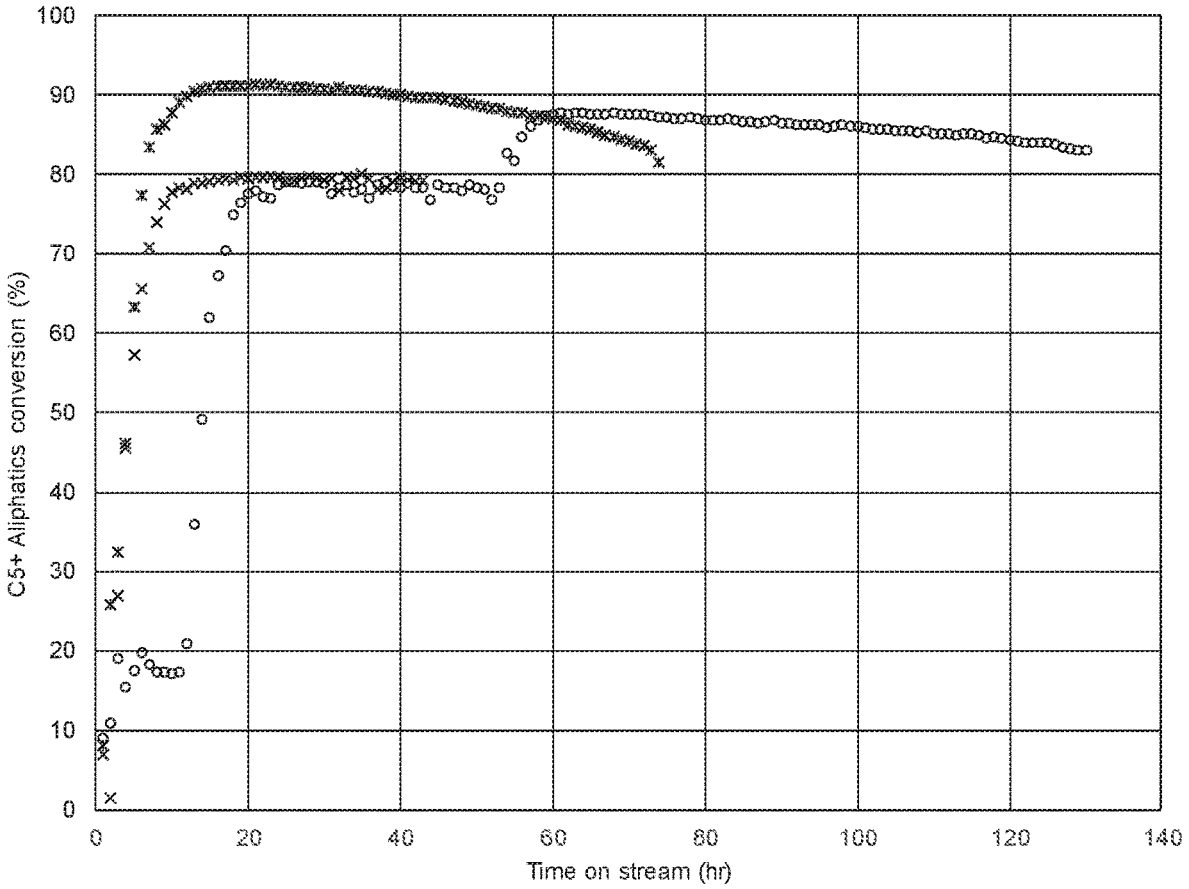
FIG. 2 is a plot of $C_{5+}$ aliphatics conversion versus time on stream for silica bound catalyst.

In this example, the liquid feed rate was 60 cc/hr, and the mole ratio of hydrogen to feed was 1:1, corresponding to a hydrogen mol % of 50 and a hydrogen partial pressure of 20 psia with a total pressure of 40 psia. The space time in the catalyst bed was 8.4 seconds and the liquid space velocity was 1.0 $hr^{-1}$. Feed to the reactor was cut in at 425° C. and the temperature was ramped to 600° C., reaching reaction temperature at 5 hours on stream. Conversion of $C_{5+}$ non-aromatics started at 91% but dropped throughout the run as shown by the asterisks in FIG. 2.

Example 4

In this example, the liquid feed rate was 30 cc/hr, and the mole ratio of hydrogen to feed was 4.5:1, corresponding to a hydrogen mol % of 82 and a hydrogen partial pressure of 33 psia with a total pressure of 40 psia. The space time in the catalyst bed was 6.1 seconds and the liquid space velocity was 1.0 $hr^{-1}$. Feed to the reactor was cut in at 425° C. and the temperature was ramped to 585° C., reaching reaction temperature at 5 hours on stream. Conversion of $C_{5+}$ non-aromatics was stable at 79% through 40 hours as shown by the x's in FIG. 2.

Example 5

A composite of spent catalysts containing 14 wt % carbon from Example 3 and other similar experiments was combined and loaded in a quartz reactor and placed in a furnace. After heating the catalyst in the reactor under nitrogen to 360° C., the nitrogen was replaced with 0.1 wt % oxygen in nitrogen at 5 standard L/min. at atmospheric pressure. Following this a number of increases in oxygen content and temperature were made. Conditions were step changed as follows: Oxygen content was increased to 0.5 wt %, then temperature was raised to 510° C., then oxygen content increased to 1 wt %, then temperature raised to 565° C., then oxygen content was raised to 4 wt % and finally to 20 wt %. When temperature was increased, oxygen was cut off with only nitrogen entering the catalyst in the reactor. If the temperature increased another 10° C. over set point when the oxygen was cut back in, the temperature was reverted back to the starting temperature under nitrogen for at least an hour to allow the temperature to moderate back to the starting temperature before increasing temperature again. When oxygen concentration was increased, if the temperature increased by more than 10° C., oxygen was cut off to allow the temperature of the bed to moderate back to the starting temperature under nitrogen for at least an hour before cutting oxygen back in at the higher concentration. Carbon content of this regenerated catalyst was 0.02%.

The regenerated catalyst was tested with the same feed and conditions as was used as Example 4 after an initial period of 11 hours at 485° C. Aliphatic conversion was the same as observed in Example 4 as shown by the circles in the FIG. 2. After 52 hours on stream, conditions were changed to be the same as Example 3. Conversion of $C_{5+}$ aliphatics was 87%, equivalent to the conversion observed in Example 3 after partial deactivation.

Example 6

An additional portion of the catalyst used in Example 1 was used in reaction testing with the same feed as was used in Example 2. The test ran for 200 hours with conditions ranging from 0.6-1.2 LHSV, 565-585° C., and a mole ratio of hydrogen to hydrocarbon of 3-4.5 at 172 kPa (g) (25 psig). At the end of the experiment the catalyst was unloaded and analyzed and found to contain 6.63 wt % carbon. The catalyst was then loaded in a quartz reactor in a furnace. After heating in nitrogen to 360° C., the nitrogen was replaced with 0.1 wt % oxygen in nitrogen at 5 standard L/min at atmospheric pressure. Following this, a number of step increases in oxygen content and temperature were made according to the procedure in Example 5. Carbon content of this regenerated catalyst was 0.02%.

Figure 3:
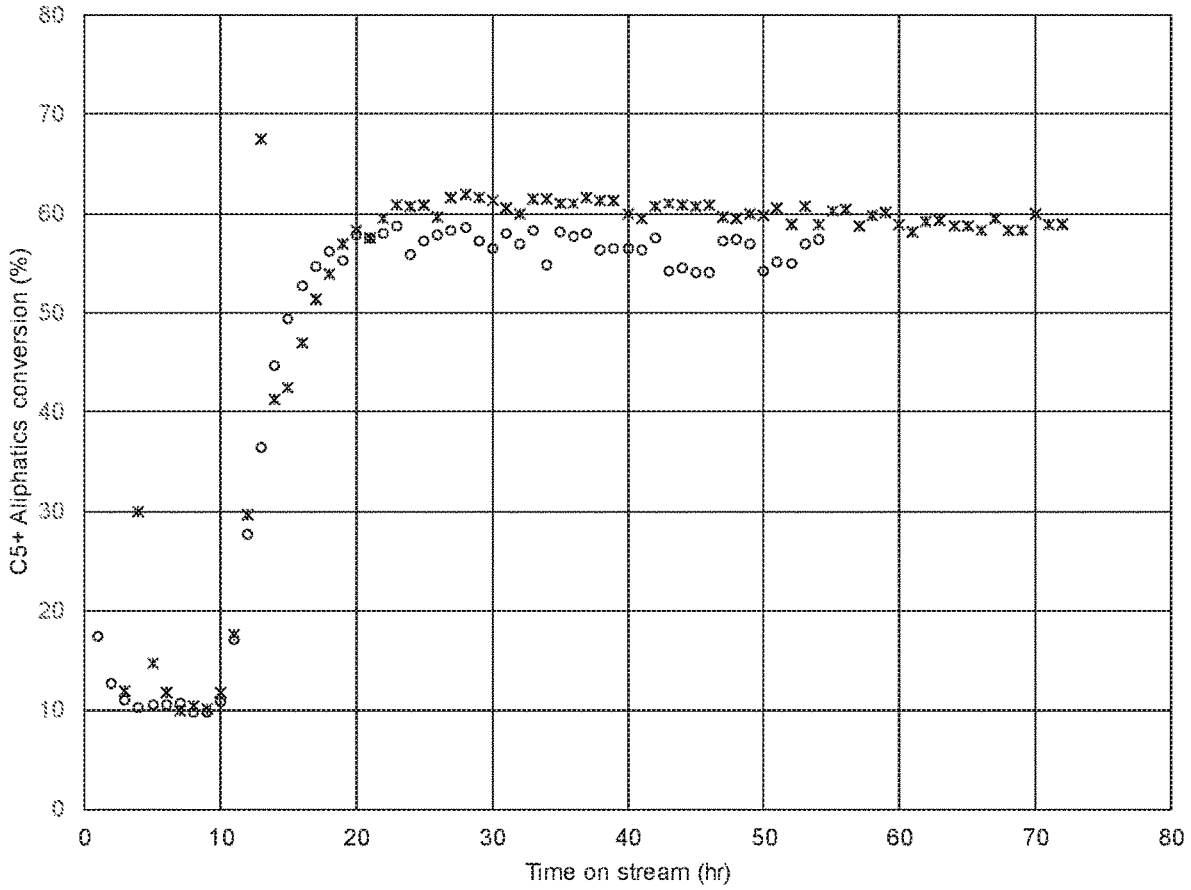
FIG. 3 is a plot of $C_{5+}$ aliphatics conversion versus time on stream for aluminum phosphate bound catalyst.

Forty cubic centimeters of the regenerated catalyst was loaded in a fixed bed reactor in a furnace in three separate catalyst plugs of 10, 10 and 20 cc separated by quartz wool and alpha alumina filler. The reactor was configured such that the reformate feed with the composition shown in Table 2 was vaporized and mixed with hydrogen in a reactor pre-heat zone. Liquid and vapor products were separated at the reactor outlet which was maintained at 172 kPa (g) (25 psig). The reactor was heated to 424° C., measured at 2 inches above catalyst bed inlet, under hydrogen, and liquid feed flow was initiated at a flow rate to achieve 3 $hr^{-1}$ LHSV, and a mole ratio of hydrogen to hydrocarbon of 4.5:1. Then temperature was increased to 495° C. for 10 hours. Finally, temperature was increased to 579° C., liquid feed was decreased to achieve 0.9 $hr^{-1}$ LHSV and hydrogen flow rate was decreased to achieve mole ratio of hydrogen to hydrocarbons of 3:1. Flows continued for an additional 60 hours. The gas and liquid products were analyzed separately by gas chromatography. Conversion of aliphatics was determined by summing aliphatics in the feed and summing the of aliphatics in the gas and liquid products in weight percent and dividing the difference by aliphatics in the feed in weight percent and is shown by the asterisks in FIG. 3.

Example 7

To compare regenerated catalyst performance from Example 6 to fresh catalyst at the same conditions, an additional 40 cc of fresh catalyst was loaded in a fixed bed reactor in a furnace in three separate catalyst plugs of 10, 10 and 20 cc separated by quartz wool and alpha alumina filler. This catalyst was identical to the catalyst prepared in Example 1 and to the fresh catalyst used to generated the spent catalyst in Example 6. The reactor was configured such that the reformate feed with the composition shown in Table 1 was vaporized and mixed with hydrogen in a reactor pre-heat zone. Liquid and vapor products were separated at the reactor outlet which was maintained at 172 kPa (g) (25 psig). The reactor was heated to 424° C. measured at 2 inches above catalyst bed inlet under hydrogen, and liquid feed flow was initiated at a flow rate to achieve 3 $hr^{-1}$ LHSV and a mole ratio of hydrogen to hydrocarbons was 4.5:1. Then temperature was increased to 495° C. for 10 hours. Finally, temperature was increased to 579° C., liquid feed was decreased to achieve 0.9 $hr^{-1}$ LHSV and hydrogen flow rate was decreased to achieve mole ratio of hydrogen to hydrocarbons of 3:1. Flows continued for an additional 43 hours. The gas and liquid products were analyzed separately by gas chromatography. Conversion of aliphatics was determined by summing aliphatics in the feed and summing the of aliphatics in the gas and liquid products in weight percent and dividing the difference by aliphatics in the feed in weight percent and is shown by circles in FIG. 3. The regenerated catalyst in Example 6 had activity slightly higher than that of the fresh catalyst.

Specific Embodiments

While the Following is Described in Conjunction with Specific Embodiments, it will be understood that this description is intended to illustrate and not limit the scope of the preceding description and the appended claims.

A first embodiment of the invention is a process for producing ethylene, propylene and aromatics comprising passing a feed stream comprising olefins, paraffins and alkylaromatics in the range of $C_4$ to $C_{11}$ into a reaction zone and contacting the feed stream with a catalyst to crack olefins and paraffins and dealkylate alkylaromatics to form a cracked product comprising olefins and aromatics, wherein the catalyst comprises about 30 to about 80% by weight acidic zeolite with a maximum pore diameter of greater than 5 Angstroms and about 20 to about 70% by weight of a low-acidic binder selected from the group consisting of aluminum phosphate, silicon oxide and zirconium oxide. An embodiment of the invention is one, any or all of prior embodiments in this paragraph up through the first embodiment in this paragraph wherein the binder comprises $AlPO_4$. An embodiment of the invention is one, any or all of prior embodiments in this paragraph up through the first embodiment in this paragraph wherein the acidic zeolite has a molar $Si/Al_2$ ratio between about 200 and about 1200. An embodiment of the invention is one, any or all of prior embodiments in this paragraph up through the first embodiment in this paragraph wherein the binder comprises a molar ratio of Al:P of about 0.85 to about 2.0. An embodiment of the invention is one, any or all of prior embodiments in this paragraph up through the first embodiment in this paragraph wherein the catalyst comprises about 40 to 70% by weight acidic zeolite and about 30 to about 60% by weight low-acidic binder. An embodiment of the invention is one, any or all of prior embodiments in this paragraph up through the first embodiment in this paragraph wherein the catalyst particles are spherical. An embodiment of the invention is one, any or all of prior embodiments in this paragraph up through the first embodiment in this paragraph wherein the zeolite is a silicalite. An embodiment of the invention is one, any or all of prior embodiments in this paragraph up through the first embodiment in this paragraph wherein the reaction zone is in a moving-bed reactor. An embodiment of the invention is one, any or all of prior embodiments in this paragraph up through the first embodiment in this paragraph wherein a portion of the catalyst is periodically removed to a regeneration section, the catalyst is then treated to remove catalyst contaminants and then the treated catalyst is returned to the reaction zone. An embodiment of the invention is one, any or all of prior embodiments in this paragraph up through the first embodiment in this paragraph wherein the treating of catalyst comprises contacting it with a gas comprising about 0.1 to about 21 wt % oxygen at a temperature of about 360 to about 650° C. An embodiment of the invention is one, any or all of prior embodiments in this paragraph up through the first embodiment in this paragraph further comprising reaction conditions in the reaction zone including a weight hourly space velocity of between about 0.75 and about 4.0 $hr^{-1}$. An embodiment of the invention is one, any or all of prior embodiments in this paragraph up through the first embodiment in this paragraph wherein the weight hourly space velocity is no more than about 3.0 $hr^{-1}$. An embodiment of the invention is one, any or all of prior embodiments in this paragraph up through the first embodiment in this paragraph wherein the alkali content of the catalyst is no more than 100 wppm.

A second embodiment of the invention is a process for producing ethylene, propylene and aromatics comprising passing a feed stream comprising olefins, paraffins and alkylaromatics in the range of $C_4$ to $C_{11}$ into a reaction zone and contacting the feed stream with a spherical catalyst to crack olefins and paraffins and dealkylate alkylaromatics to form a cracked product comprising olefins and aromatics, wherein the catalyst comprises about 30 to 80% by weight zeolite with a maximum pore diameter of at least 5 Angstroms and about 20 to 70% by weight of a binder comprising $AlPO_4$. An embodiment of the invention is one, any or all of prior embodiments in this paragraph up through the second embodiment in this paragraph wherein the acidic zeolite has a molar $Si/Al_2$ ratio between about 300 and 500. An embodiment of the invention is one, any or all of prior embodiments in this paragraph up through the second embodiment in this paragraph wherein the binder comprises a molar ratio of Al:P of about 0.95 to about 1.4. An embodiment of the invention is one, any or all of prior embodiments in this paragraph up through the second embodiment in this paragraph further comprising reaction conditions in the reaction zone include a weight hourly space velocity of between about 0.75 and 3.0 $hr^{-1}$. An embodiment of the invention is one, any or all of prior embodiments in this paragraph up through the second embodiment in this paragraph wherein the alkali content of the catalyst is no more than 100 ppm.

A third embodiment of the invention is a process for producing ethylene, propylene and aromatics comprising passing a feed stream comprising olefins, paraffins and alkylaromatics in the range of $C_4$ to $C_{11}$ into a reaction zone and contacting the feed stream with a catalyst to crack olefins and paraffins and dealkylate alkylaromatics to form a cracked product stream comprising olefins and aromatics, wherein the catalyst comprises about 30 to 80% by weight acidic zeolite with an maximum pore diameter of at least 5 Angstroms and about 20 to 70% by weight of a binder comprising $AlPO_4$; and periodically removing a portion of the catalyst to a regeneration section, treating the catalyst to remove catalyst contaminants and returning the catalyst to the reaction zone. An embodiment of the invention is one, any or all of prior embodiments in this paragraph up through the third embodiment in this paragraph further characterized in that within the reaction zone reaction conditions include a weight hourly space velocity of between about 0.75 and 3.0 $hr^{-1}$.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for producing ethylene, propylene and aromatics comprising:

passing a feed stream comprising olefins, paraffins and alkylaromatics in the range of $C_4$ to $C_{11}$ into a reaction zone;

contacting said feed stream with a catalyst to crack olefins and paraffins and dealkylate alkylaromatics to form a cracked product comprising olefins and aromatics, wherein an alkali content of the catalyst is no more than 200 wppm, wherein said catalyst comprises about 30 to about 80% by weight acidic zeolite with a maximum pore diameter of greater than 5 Angstroms and about 20 to about 70% by weight of a low-acidic binder selected from the group consisting of aluminum phosphate, silicon oxide and zirconium oxide, and wherein said acidic zeolite has a molar $Si/Al_2$ ratio between about 200 and about 1200; and, adding a stream comprising hydrogen to the reaction zone, wherein a molar ratio of hydrogen to $C_{5+}$ hydrocarbons at an inlet to the reaction zone is about 3:1 to about 6:1, and wherein at least 50 wt % of alkyl aromatics containing $C_2$-$C_4$ alkyl chains are dealkylated to the corresponding light olefin and corresponding aromatics.

2. The process of claim 1 wherein said binder comprises aluminum phosphate.

3. The process of claim 1 wherein said acidic zeolite has a molar $Si/Al_2$ ratio between about 300 and about 500.

4. The process of claim 2 wherein said binder comprises a molar ratio of Al:P of about 0.85 to about 2.0.

5. The process of claim 1 wherein said catalyst comprises about 40 to 70% by weight acidic zeolite and about 30 to about 60% by weight low-acidic binder.

6. The process of claim 1 wherein said catalyst comprises spherical particles.

7. The process of claim 1 wherein said zeolite is a silicalite.

8. The process of claim 1 wherein said reaction zone is in a moving-bed reactor.

9. The process of claim 8 wherein a portion of said catalyst is periodically removed to a regeneration section, said catalyst is then treated to remove catalyst contaminants and then said treated catalyst is returned to said reaction zone.

10. The process of claim 9 wherein the treating of catalyst comprises contacting it with a gas comprising about 0.1 to about 21 wt % oxygen at a temperature of about 360 to about 650° C.

11. The process of claim 1 wherein the molar ratio of hydrogen to $C_{5+}$ hydrocarbons at the inlet to the reaction zone is about 4.5:1 to about 6:1.

12. The process of claim 1 wherein the alkali content of the catalyst is no more than 70 wppm.

13. A process for producing ethylene, propylene and aromatics comprising:

passing a feed stream comprising olefins, at least about 10 wt % paraffins and at least about 15 wt % alkylaromatics in the range of $C_4$ to $C_{11}$ into a reaction zone;

contacting said feed stream with a spherical catalyst to crack olefins and paraffins and dealkylate alkylaromatics to form a cracked product comprising olefins and aromatics, wherein an alkali content of the catalyst is no more than 200 wppm, wherein said catalyst comprises about 30 to 80% by weight zeolite with a maximum pore diameter of at least 5 Angstroms and about 20 to 70% by weight of a binder comprising $AlPO_4$, and wherein said zeolite has a molar $Si/Al_2$ ratio between about 200 and about 1200; and, adding a stream comprising hydrogen to the reaction zone, wherein a molar ratio of hydrogen to $C_{5+}$ hydrocarbons at an inlet to the reaction zone is about 3:1 to about 6:1, and wherein at least 50 wt % of alkyl aromatics containing $C_2$-$C_4$ alkyl chains are dealkylated to the corresponding light olefin and corresponding aromatics.

14. The process of claim 13 wherein the molar ratio of hydrogen to $C_{5+}$ hydrocarbons at the inlet to the reaction zone is about 4.5:1 to about 6:1.

15. The process of claim 13 wherein said zeolite has a molar $Si/Al_2$ ratio between about 300 and 500.

16. The process of claim 13 wherein said binder comprises a molar ratio of Al:P of about 0.95 to about 1.4.

17. The process of claim 13 wherein the alkali content of the catalyst is no more than 70 ppm.

18. A process for producing ethylene, propylene and aromatics comprising:

passing a feed stream comprising olefins, paraffins and alkylaromatics in the range of $C_4$ to $C_{11}$ into a reaction zone and contacting said feed stream with a catalyst to crack olefins and paraffins and dealkylate alkylaromatics to form a cracked product stream comprising olefins and aromatics, wherein an alkali content of the catalyst is no more than 200 wppm, wherein said catalyst comprises about 30 to 80% by weight acidic zeolite with a maximum pore diameter of at least 5 Angstroms and about 20 to 70% by weight of a binder comprising $AlPO_4$, wherein said acidic zeolite has a molar $Si/Al_2$ ratio between about 200 and about 1200, and wherein reaction conditions in the reaction zone including a weight hourly space velocity of between about 0.75 and about 1.8 $hr^{-1}$;

adding a stream comprising hydrogen to the reaction zone, wherein a molar ratio of hydrogen to $C_{5+}$ hydrocarbons at an inlet to the reaction zone is about 3:1 to about 6:1; and, periodically removing a portion of said catalyst to a regeneration section, treating said catalyst to remove catalyst contaminants and returning said catalyst to said reaction zone, wherein at least 50 wt % of alkyl aromatics containing $C_2$-$C_4$ alkyl chains are dealkylated to the corresponding light olefin and corresponding aromatics.

19. The process of claim 18 wherein the molar ratio of hydrogen to $C_{5+}$ hydrocarbons at the inlet to the reaction zone is about 4.5:1 to about 6:1.

* * * * *